US008821354B1

(12) United States Patent
Tabahi

(10) Patent No.: US 8,821,354 B1
(45) Date of Patent: Sep. 2, 2014

(54) ABDOMINAL MUSCLE AND CYCLE WORKOUT MACHINE

(76) Inventor: Hazem Tabahi, Morton Grove, IL (US)

( * ) Notice: Subject to any disclaimer, the term of this patent is extended or adjusted under 35 U.S.C. 154(b) by 136 days.

(21) Appl. No.: 13/367,485

(22) Filed: Feb. 7, 2012

(51) Int. Cl.
*A63B 22/12* (2006.01)

(52) U.S. Cl.
USPC ..... 482/62; 482/140

(58) Field of Classification Search
USPC ..... 482/51, 57, 60–63, 140; D21/662, 663, D21/665
See application file for complete search history.

(56) References Cited

U.S. PATENT DOCUMENTS

| | | | | |
|---|---|---|---|---|
| 5,577,987 | A * | 11/1996 | Brown | 482/140 |
| 5,695,434 | A * | 12/1997 | Dalebout et al. | 482/96 |
| D413,947 | S * | 9/1999 | Gvoich | D21/676 |
| 6,270,446 | B1 * | 8/2001 | Abelbeck et al. | 482/57 |
| 6,413,192 | B2 * | 7/2002 | Abelbeck | 482/57 |
| 6,547,701 | B1 * | 4/2003 | Eschenbach | 482/57 |
| 6,645,129 | B2 * | 11/2003 | Eschenbach | 482/140 |
| 6,817,968 | B2 * | 11/2004 | Galbraith et al. | 482/72 |
| 6,923,749 | B1 * | 8/2005 | Smith | 482/72 |
| 7,232,405 | B2 * | 6/2007 | Ko | 482/146 |
| 7,341,547 | B2 * | 3/2008 | Liao | 482/140 |
| 2004/0192522 | A1 * | 9/2004 | Hippensteel | 482/142 |
| 2007/0281840 | A1 * | 12/2007 | Tsai | 482/140 |

* cited by examiner

*Primary Examiner* — Loan H Thanh
*Assistant Examiner* — Nyca T Nguyen
(74) *Attorney, Agent, or Firm* — Kyle Fletcher

(57) ABSTRACT

The abdominal muscle and cycle workout machine is a workout machine that features a cycling apparatus working in conjunction with an abdominal roller machine. The abdominal muscle and cycle workout machine features a modified workout bench having curved contours that enable an end user to lie in a recumbent position in order to perform cycling exercises while simultaneously conducting exercise that targets abdominal muscles. The machine includes a torsion dial to adjust the tension on the cycling apparatus. The abdominal roller machine includes opposing handlebars that an end user grabs onto in order to perform abdominal crunches while simultaneously performing a cycling exercise.

10 Claims, 7 Drawing Sheets

ABDOMINAL MUSCLE AND CYCLE WORKOUT MACHINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of workout equipment, more specifically, a workout machine that enables simultaneous muscle target groups pertaining to the abdominal region as well as the thigh and calf.

B. Discussion of the Prior Art

As will be discussed immediately below, no prior art discloses an apparatus that enables an end user to conduct a bicycle crunch wherein a recumbent pedaling mechanism works in conjunction with an abdominal roller machine; wherein the apparatus includes a workout bench upon which the abdominal roller machine is provided, and from a distal end a cycling apparatus is provided, which requires the end user to perform a cycling exercise while in a recumbent position; wherein the apparatus further includes a torsion dial that adjusts the portion of the workout bench features opposing handlebars that an end user grabs when conducting a crunch exercise.

The Smith Patent (U.S. Pat. No. 6,923,749) discloses a machine for performing abdominal crunches and pedaling at the same time. However, the machine uses resistance from an arm to a respective leg such that upon motion of a leg a respective arm moves accordingly, and does not rely upon independent cycling movement with respect to exercises targeting abdominal miscles.

The Dalebout et al. Patent (U.S. Pat. No. 5,695,434) discloses a riding type exercise machine that also exercises abdominal muscles by allowing the person to bend forward and lean back. However, the machine employs linkages that correlate movement of a leg to movement of a respective arm, and is not a cycling machine extending from a workout bench upon which exercises are performed that target abdominal muscles.

The Galbraith et al. Patent (U.S. Pat. No. 6,817,968) discloses an exercise machine for performing multiple exercises such as pedaling and also rowing. Again, the exercise machine simulates rowing by linking motion of a leg with a corresponding arm, and does not enabling indpendency between cycling exercise and exercise targeting abdominal muscles.

The Eschenbach Patent (U.S. Pat. No. 6,547,701) discloses an elliptical pedaling abdominal exercising apparatus. However, the apparatus uses alternating pushing exercises of the legs as opposed to a cycling device that enables simultaneous exercise of abdominal muscles upon a workout bench.

The Abelbeck Patent (U.S. Pat. No. 6,413,192) discloses a combined abdominal sit up assisting device and stationary pedaling device. Again, the device includes linkaging that connects movement of the cycle member to an upper frame, as opposed to a workout bench featuring a cycle exercise device that enables simultaneous workout of the legs and abdominal muscles via independent means.

The Gvoich Patent (U.S. Pat. No. Des. 413,947) illustrates a design for an exercise machine that combines the actions of abdominal crunches and pedaling, which fails to depict a workout bench having cyling means integrated thereon.

The Abelbeck et al. Patent (U.S. Pat. No. 6,270,446) discloses an exercise device being capable of providing aerobic exercise and abdominal muscle conditioning. Again, the device includes linkaging that connects movement of the cycle member to an upper frame, as opposed to a workout bench featuring a cycle exercise device that enables simultaneous workout of the legs and abdominal muscles via independent means.

While the above-described devices fulfill their respective and particular objects and requirements, they do not describe an apparatus that enables an end user to conduct a bicycle crunch wherein a recumbent pedaling mechanism works in conjunction with an abdominal roller machine; wherein the apparatus includes a workout bench upon which the abdominal roller machine is provided, and from a distal end a cycling apparatus is provided, which requires the end user to perform a cycling exercise while in a recumbent position; wherein the apparatus further includes a torsion dial that adjusts the tension on the cycling apparatus; wherein the abdominal roller portion of the workout bench features opposing handlebars that an end user grabs when conducting a crunch exercise. In this regard, the abdominal muscle and cycle workout machine departs from the conventional concepts and designs of the prior art.

SUMMARY OF THE INVENTION

The abdominal muscle and cycle workout machine is a workout machine that features a cycling apparatus working in conjunction with an abdominal roller machine. The abdominal muscle and cycle workout machine features a modified workout bench having curved contours that enable an end user to lie in a recumbent position in order to perform cycling exercises while simultaneously conducting exercise that targets abdominal muscles. The machine includes a torsion dial to adjust the tension on the cycling apparatus. The abdominal roller machine includes opposing handlebars that an end user grabs onto in order to perform abdominal crunches while simultaneously performing a cycling exercise. The workout bench includes a rotating portion upon which a back of an end user rests, which rotates in conjunction with the opposing handlebars when conducting an abdominal crunch.

An object of the invention is to provide a workout machine that enables an end user to individually or simultaneously conduct cycling exercises as well as abdominal muscle exercises.

A further object of the invention is to provide an abdominal roller machine that has a modified bench including curved contours that enable the pedaling movement of the legs without restriction.

Another object of the invention is to provide the cycling apparatus at an elevation above that of the workout bench such that the legs and knees of the end user move and rotate above the chest of the end user between abdominal crunches.

A further object of the invention is to provide a torsion dial that adjusts the tension on the cycling apparatus.

Another object of the invention is to provide a portion of the bench that rotates upwardly from a pivot point, and in conjunction with opposing handlebars shall enable an end user to rest their back thereon when conducting abdominal crunches.

These together with additional objects, features and advantages of the abdominal muscle and cycle workout machine will be readily apparent to those of ordinary skill in the art upon reading the following detailed description of presently preferred, but nonetheless illustrative, embodiments of the abdominal muscle and cycle workout machine when taken in conjunction with the accompanying drawings.

In this respect, before explaining the current embodiments of the abdominal muscle and cycle workout machine in detail, it is to be understood that the abdominal muscle and cycle workout machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the abdominal muscle and cycle workout machine.

It is therefore important that the claims be regarded as including such equivalent construction insofar as they do not depart from the spirit and scope of the abdominal muscle and cycle workout machine. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
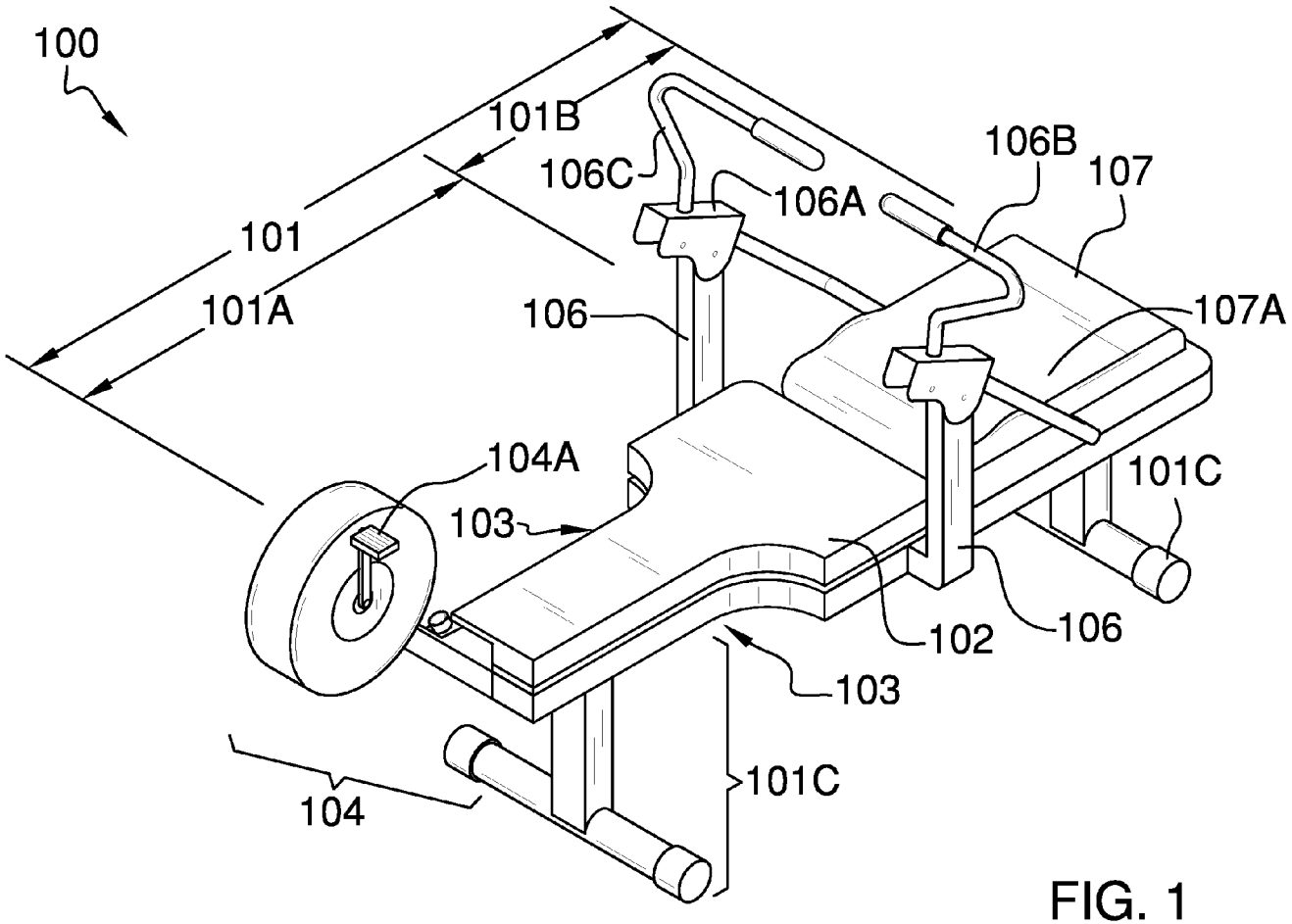
FIG. 1 illustrates a perspective view of the abdominal muscle and cycle workout machine by itself.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. An abdominal muscle and cycle workout machine 100 (hereinafter invention) includes a bench 101 primarily composed of a first bench member 101A and a second bench member 101B. The first bench member includes a padded structure 102 along a top surface, which is designed to provide comfort to an end user 130 when using the invention 100.

The first bench member 101A features curve contours 103 along a first distal end 105A of the invention 100. The curve contours 103 are important to the overall function of the invention 100 in that the curve contours provide a means for the end user 130 to manipulate their legs 131 and feet 132 when using a cycling apparatus 104 that is mounted at the first distal end 105A of the invention 100.

Figure 1A:
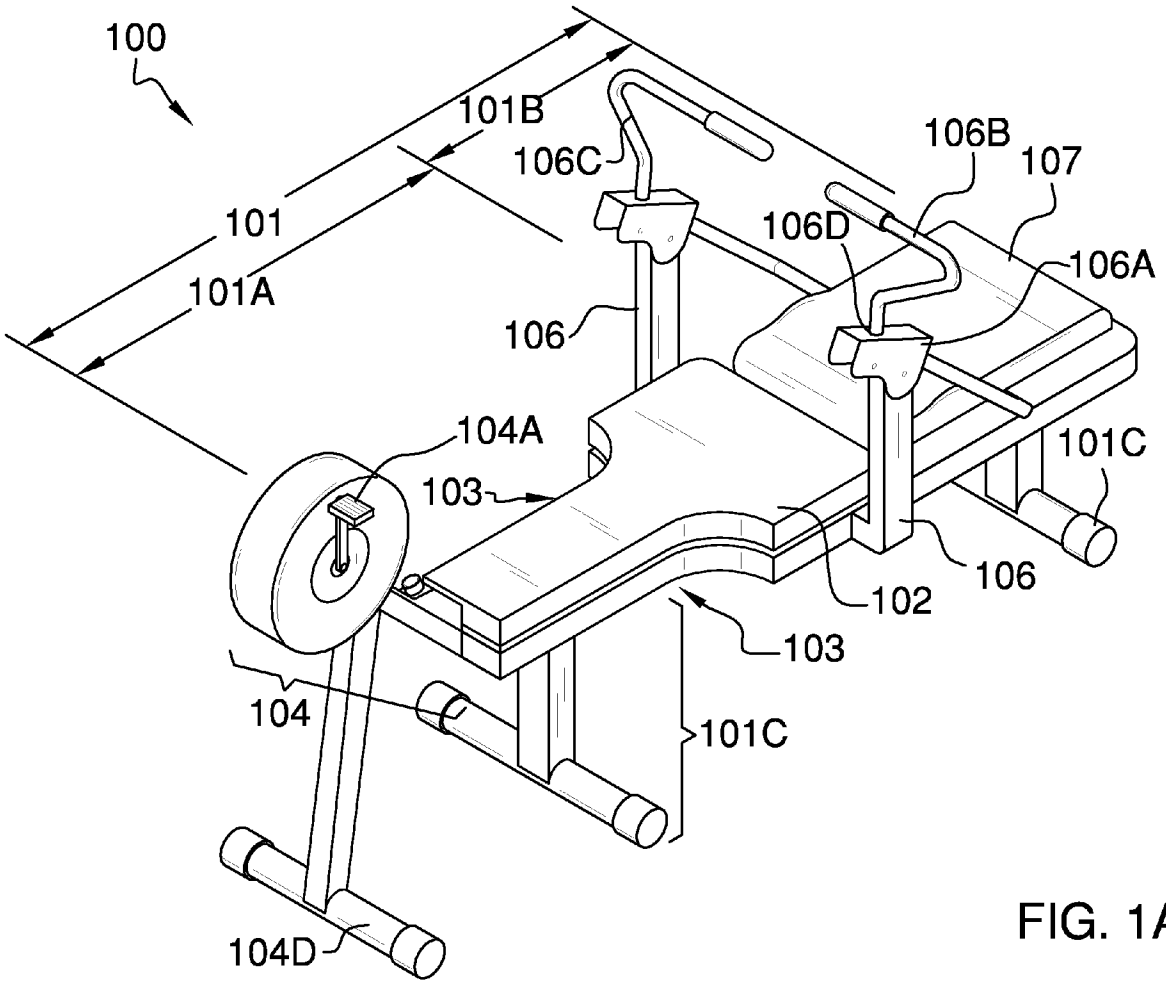
FIG. 1A illustrates a perspective view of the abdominal muscle and cycle workout machine by itself wherein the cycling apparatus includes an additional support structure that rises up from the ground adjacent the workout bench, and which provides extra support to the cycling apparatus.
Figure 2:
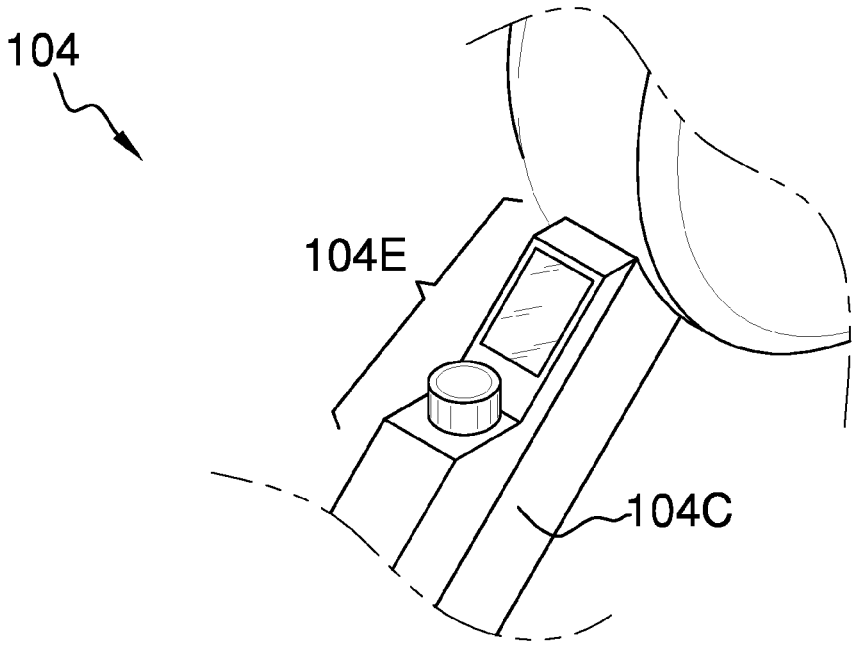
FIG. 2 illustrates a detail of the torsion dial.

The cycling apparatus 104 includes foot pedals 104A that are oriented 180 degrees with respect to one another, and which is well known in the art of cycling equipment. The cycling apparatus 104 extends from the first distal end 105A of the first bench member 101A. Moreover, the cycling apparatus 104 is provided at an elevation 104B above that of the bench 101 such that the end user's 130 feet 132 and legs 131 are elevated. The cycling apparatus 104 includes a first support member 104C, which extends upwardly and away from the first distal end 105A of the first bench member 101A. Referring to FIG. 1A, a second support member 104D may be included with the invention 100 in order to provide additional support to the cycling apparatus 104.

The bench 101 includes support structure 101C, which elevates the padded structure 102 above a ground surface, and at a level orientation, respectively. The padded structure 102 has shapes that mirror the respective bench members 101A and 101B.

Handlebar supports 106 extend from opposing sides of the bench 101. A handlebar hinge 106A is affixed to a top of each handlebar support 106. The handlebar hinges 106 attach to either a left handlebar 106B or a right handlebar 106C. The left handlebar 106B and the right handlebar 106C are grabbed via hands 134 the end user 130 in order to perform a rolling abdominal exercise, which is also known in the respective art unit.

The left handlebar 106B and the right handlebar 106C are formed of a curved shape, and attach at a top position 106D of the handlebar hinge 106A at a distance from a second distal end 105B.

A back support 107 is a padded structure that rests atop of the second bench member 101B, and works in conjunction with the left handlebar 106B and the right handlebar 106C. Moreover, the back support 107 is attached to the handlebar hinges 106A via linkage member 107A. The linkage member 107A is a "U" shaped member that extends from the handlebar hinges 106A around to a rear surface 107B of the back support 107. It shall be noted that the back support 107 is in no way affixed to the second bench member 101B, but rather translates from and to when conducting an abdominal crunch-styled exercise (see FIGS. 3, and 5-6).

Figure 5:
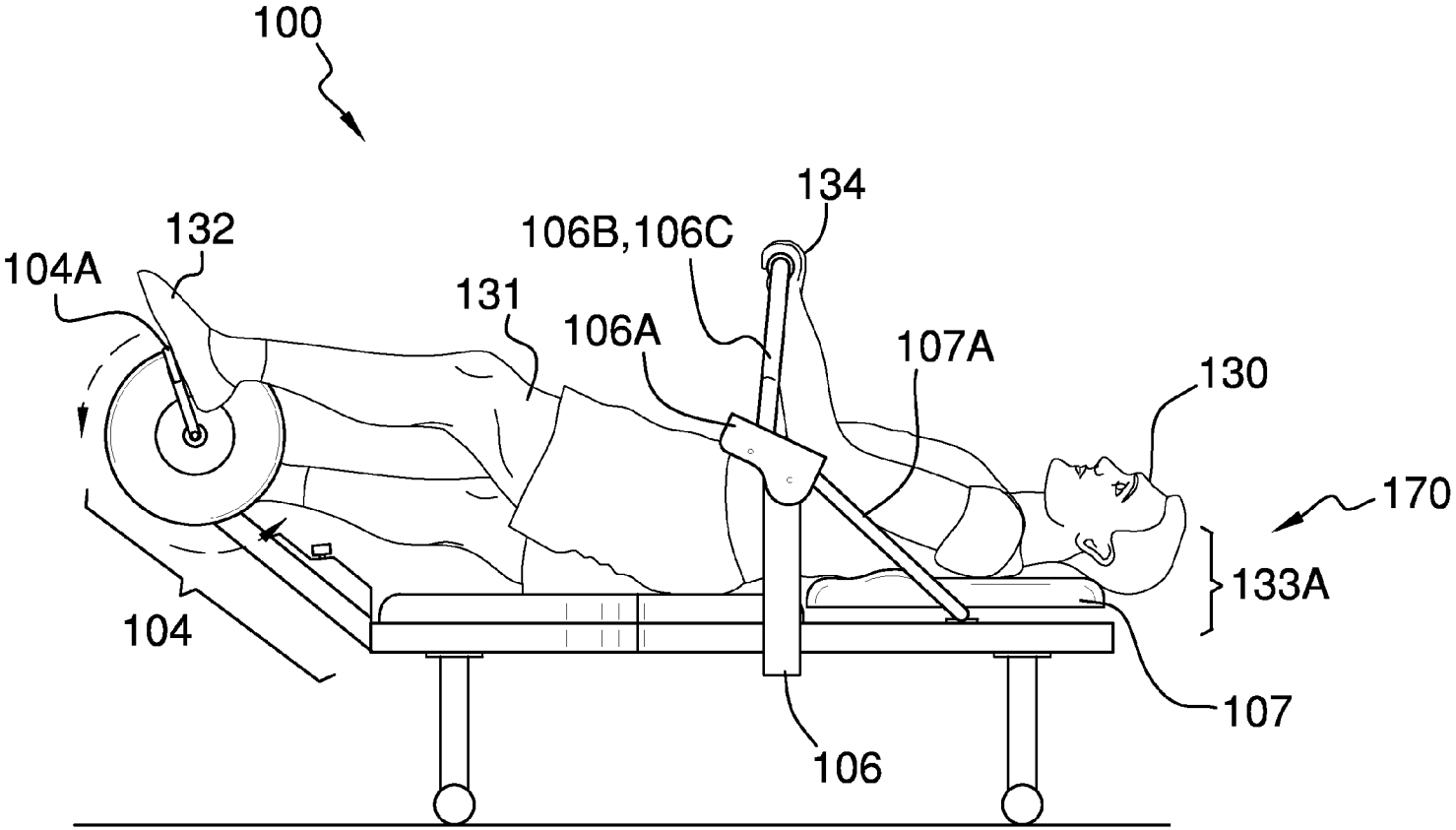
FIG. 5 illustrates a side view of the abdominal muscle and cycle workout machine in use in which the end user is lying in a recumbent position with both legs engaging both foot pedals of the cycling apparatus and with both hands grabbing the opposing handlebars.
Figure 6:
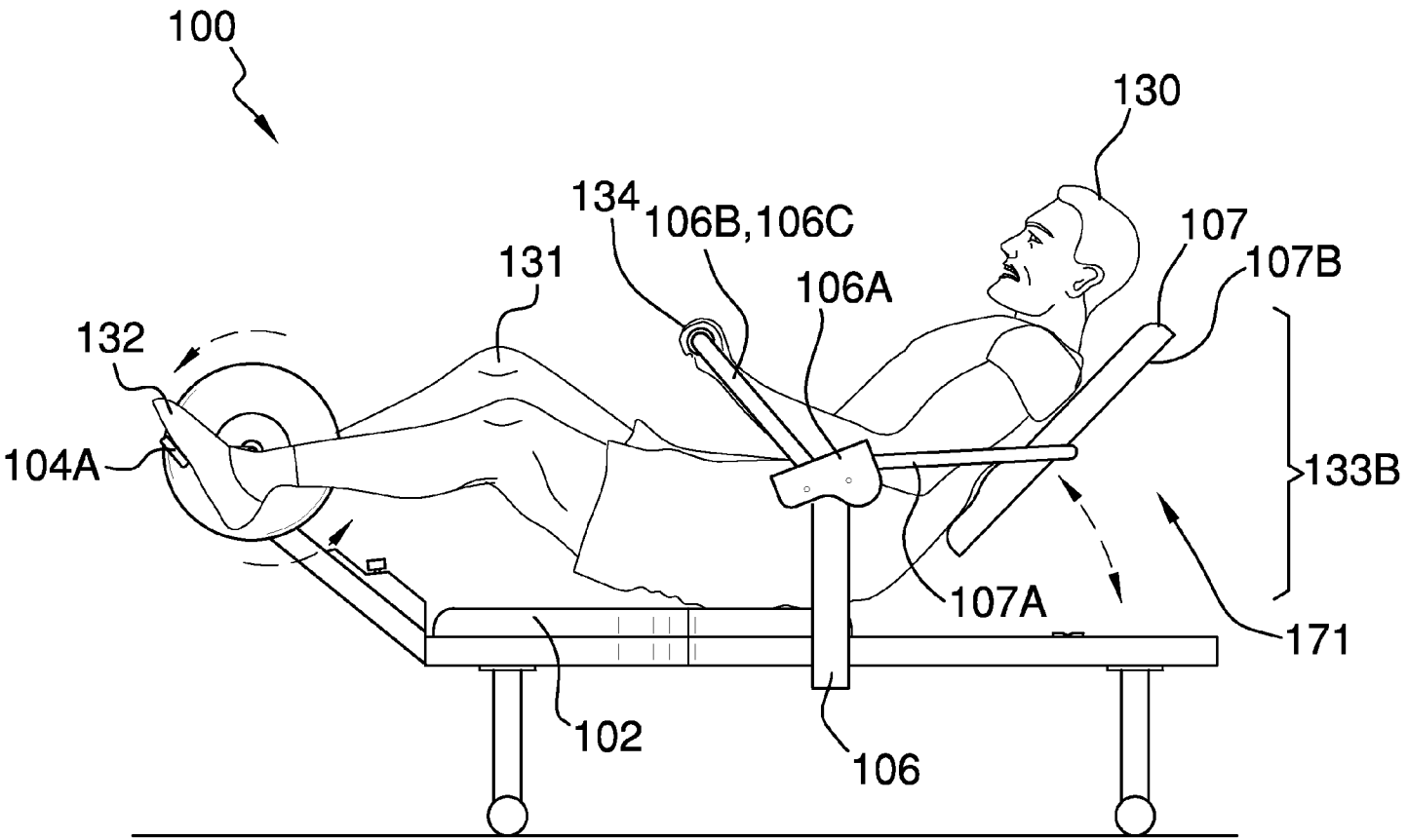
FIG. 6 illustrates a side view of the abdominal muscle and cycle workout machine in use wherein the end user has rotated the handlebars and rotating portion of the workout bench in performing an abdominal crunch while rotating the pedals of the cycling apparatus.

The linkage member 107A is secured to the back support 107, and translates the back support 107 from a flat position 170 (see FIG. 5) to an elevated and angled position 171 (see FIG. 6). The movement of the left handlebar 106E and the right handlebar 106C in conjunction with the movement of the back support 107 enable the end user 130 to conduct the abdominal crunch-styled exercise safely and properly. It shall be noted tat the back support 107 is included to prevent injury to the end user 130.

It shall be noted that the linkage member 107A maintains an angle 107C with respect to the back support 107, and which is consistent between the flat position 170 and the elevated and angled position 171. The linkage member 107A attaches to the handlebar hinge 106A at a second position 106E.

Figure 3:
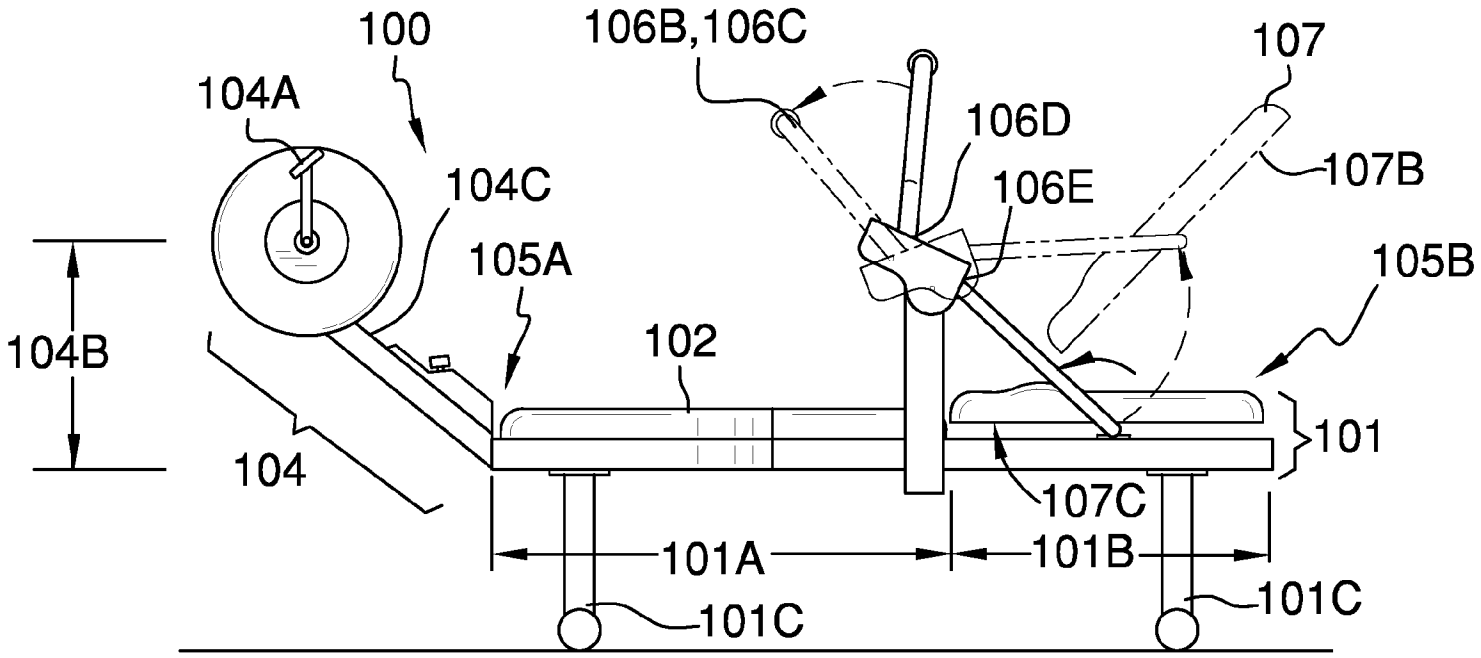
FIG. 3 illustrates a side view of the abdominal muscle and cycle workout machine by itself, and detailing the rotational movement of the opposing handlebars in conjunction with the rotational portion of the workout bench.
Figure 4:
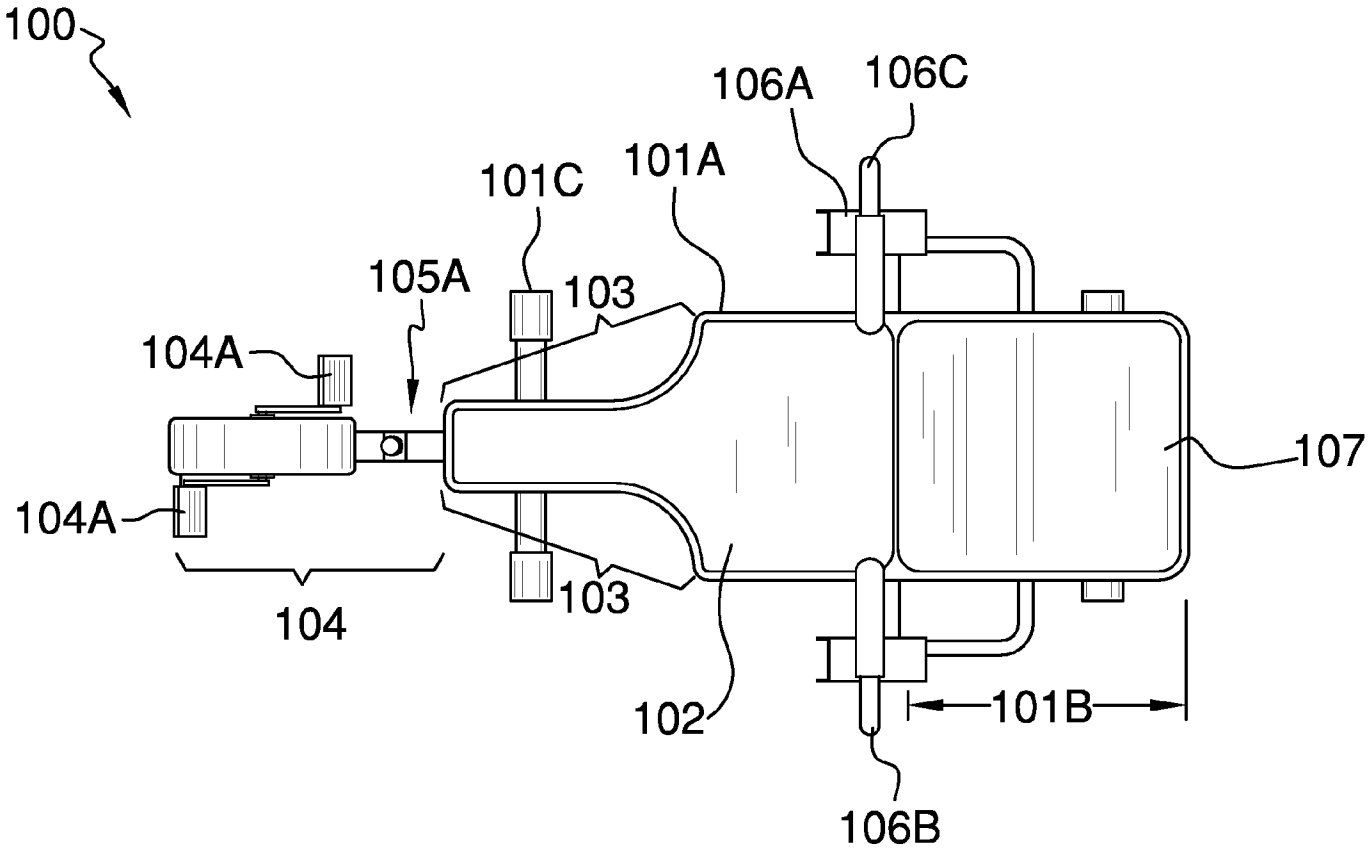
FIG. 4 illustrates a top view of the abdominal muscle and cycle workout machine detailing the contours of the abdominal roller machine, which enable legs of an end user to manipulate the cycling apparatus in an unobstructed fashion.

Referring to FIG. 3, as the handlebar hinge 106A rotates about the handlebar support 106, two things occur: (1) the left/right handlebar 106B/C rotates about the handlebar support 106, and (2) the back support 107 translates from the flat position 170 to the elevated and angled position 171, or vice versa.

The cycling apparatus 104 includes a torsion dial 104E, which enables adjustment of the cycling apparatus 104, and is well known in the respective art unit. The torsion dial 104E is located on the first support member 104C, and adjusts the level of resistance applied onto the foot pedals 104A.

The invention 100 is used to conduct cycling exercises in conjunction with and simultaneous to abdominal crunch-styled exercises. Referring to FIGS. 5 and 6, the end user 130 is rolling from a recumbent position 133A (see FIG. 5) to an inclined position 133B (see FIG. 6) while simultaneously pedaling the feet 132 via the foot pedals 104A of the cycling apparatus. The term recumbent position 133A is when the end user 130 is rested onto the back support 107 being in the flat position 170. The term inclined position 133B is when the end user 130 is rested onto the back support 107 being in the elevated and angled position 171.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. An abdominal muscle and cycle workout machine comprising:

a bench including a cycling apparatus at a first distal end, and handlebars provided at a distance from a second distal end such that an end user simultaneously conducts an abdominal muscle exercise and a cycling exercise;

wherein said bench is elevated off of a ground surface;

wherein the bench is further defined as a first bench member and a second bench member;

wherein the first bench member is adjacent the first distal end whereas the second bench member is adjacent to the second distal end;

wherein the first bench member includes padded structure atop thereof; wherein the second bench member includes a back support resting thereon, and in mechanical communication with the handlebars such that upon rotation of said handlebars, the back support translates from a flat position to an elevated and angled position, and vice versa;

wherein handlebar supports extend from opposing sides of the bench and each support a handlebar hinge atop thereof; wherein the handlebars are further defined as a left handlebar and a right handlebar attach at a top position of the handlebar hinges, respectively; wherein the handlebar hinges and the left handlebar and right handlebar rotate with respect to the handlebar supports; wherein the back support attaches to the handlebar hinges via a linkage member;

wherein the linkage member is a "U" shaped member that extends from the handlebar hinges around to a rear surface of the back support;

wherein the linkage member is secured to the back support, and translates the back support from said flat position to said elevated and angled position whilst the left handlebar and right handlebar rotate with respect to the handlebar support, and which collectively enable the end user to conduct said abdominal crunch exercise;

wherein the first bench member includes curve contours along opposing sides; wherein the curve contours enables said end user to manipulate their legs when pedaling the cycling apparatus.

2. The abdominal muscle and cycle workout machine as described in claim 1 wherein the cycling apparatus is provided at an elevation above that of the bench such that the end user's feet and legs are elevated; wherein the cycling apparatus includes a first support member, which extends upwardly and away from the first distal end of the first bench member.

3. The abdominal muscle and cycle workout machine as described in claim 2 wherein the cycling apparatus includes foot pedals that are oriented 180 degrees with respect to one another.

4. The abdominal muscle and cycle workout machine as described in claim 3 wherein the cycling apparatus includes a torsion dial, which adjusts the tension on the foot pedals.

5. The abdominal muscle and cycle workout machine as described in claim 1 wherein the linkage member maintains an angle with respect to the back support, and which is consistent between the flat position and the elevated and angled position.

6. An abdominal muscle and cycle workout machine comprising:

a bench including a cycling apparatus at a first distal end, and handlebars provided at a distance from a second distal end such that an end user simultaneously conducts an abdominal muscle exercise and a cycling exercise;

wherein said bench is elevated off of a ground surface;

wherein the end user rolls from a recumbent position to an inclined position when conducting said abdominal muscle exercise whilst simultaneously pedaling feet via foot pedals of the cycling apparatus that are oriented 180 degrees with respect to one another;

wherein the bench is further defined as a first bench member and a second bench member;

wherein the first bench member is adjacent the first distal end whereas the second bench member is adjacent to the second distal end;

wherein the first bench member includes padded structure atop thereof; wherein the second bench member includes a back support resting thereon, and in mechanical communication with the handlebars such that upon rotation of said handlebars, the back support translates from a flat position to an elevated and angled position, and vice versa;

wherein handlebar supports extend from opposing sides of the bench and each support a handlebar hinge atop thereof; wherein the handlebars are further defined as a left handlebar and a right handlebar attach at a top position of the handlebar hinges, respectively; wherein the handlebar hinges and the left handlebar and right handlebar rotate with respect to the handlebar supports; wherein the back support attaches to the handlebar hinges via a linkage member;

wherein the linkage member is a "U" shaped member that extends from the handlebar hinges around to a rear surface of the back support.

7. The abdominal muscle and cycle workout machine as described in claim 6 wherein the first bench member includes curve contours along opposing sides; wherein the curve contours enables said end user to manipulate their legs when pedaling the cycling apparatus.

8. The abdominal muscle and cycle workout machine as described in claim 7 wherein the cycling apparatus is provided at an elevation above that of the bench such that the end user's feet and legs are elevated; wherein the cycling apparatus includes a first support member, which extends upwardly and away from the first distal end of the first bench member.

9. The abdominal muscle and cycle workout machine as described in claim 6 wherein the linkage member is secured to the back support, and translates the back support from said flat position to said elevated and angled position whilst the left handlebar and right handlebar rotate with respect to the handlebar support, and which collectively enable the end user to conduct said abdominal crunch exercise; wherein the linkage member maintains an angle with respect to the back support, and which is consistent between the flat position and the elevated and angled position.

10. The abdominal muscle and cycle workout machine as described in claim 6 wherein the cycling apparatus includes a torsion dial, which adjusts the tension on the foot pedals.

* * * * *